US009027381B2

(12) United States Patent
Leibman et al.

(10) Patent No.: US 9,027,381 B2
(45) Date of Patent: May 12, 2015

(54) APPLIANCE BULK DISPENSER CALIBRATION USING A PRESSURE SENSOR

(75) Inventors: Alexander Boris Leibman, Prospect, KY (US); Jerrod Aaron Kappler, Louisville, KY (US); Lois Haeun Kwon, Morton Grove, IL (US)

(73) Assignee: General Electric Company, Schenectady, NY (US)

( * ) Notice: Subject to any disclaimer, the term of this patent is extended or adjusted under 35 U.S.C. 154(b) by 537 days.

(21) Appl. No.: 13/431,243

(22) Filed: Mar. 27, 2012

(65) Prior Publication Data

US 2013/0255329 A1 Oct. 3, 2013

(51) Int. Cl.

| | |
|---|---|
| ***G01F 25/00*** | (2006.01) |
| ***D06F 39/02*** | (2006.01) |
| ***D06F 33/02*** | (2006.01) |

(52) U.S. Cl.
CPC ..... *D06F 39/022* (2013.01); *D06F 33/02* (2013.01)

(58) Field of Classification Search
None
See application file for complete search history.

(56) References Cited

U.S. PATENT DOCUMENTS 2,712,747 A 7/1955 Edwards
5,263,367 A * 11/1993 Pippert ..... 73/168

* cited by examiner

*Primary Examiner* — Robert R Raevis
(74) *Attorney, Agent, or Firm* — Dority & Manning, P.A.

(57) ABSTRACT

A system for calibrating a fluid additive dispensing system of an appliance such as e.g., a washing machine is provided. For example, the system can calibrate for significant differences in the pressure of the water supply provided to the appliance during operation. Calibrations can also be implemented for significant differences in viscosity and/or density of the fluid additives.

17 Claims, 9 Drawing Sheets

APPLIANCE BULK DISPENSER CALIBRATION USING A PRESSURE SENSOR

FIELD OF THE INVENTION

The subject matter of the present disclosure relates generally to a dispensing system for an appliance.

BACKGROUND OF THE INVENTION

A washing machine appliance can use a variety of fluids (in addition to water) to wash and rinse laundry and other articles. For example, laundry detergents and/or stain removers may be added during wash and prewash cycles. Fabric softeners may be added during the rinse cycles.

These fluid additives must be introduced at an appropriate time during the cleaning process and in a proper amount. By way of example, adding laundry detergent and fabric softener at the same time into the water used for a laundry load is undesirable because the resulting mixture is unlikely to clean or soften as the two will negate each other. Not adding enough of either the detergent or softener to the laundry load will diminish the efficacy of the cleaning process. Conversely, adding too much detergent or softener is also undesirable.

For instance, when too much detergent is added during a wash cycle, this can leave some detergent that remains on the clothes because the rinse cycle of a washing machine may not be able to remove all of the detergent used during the wash cycle. In turn, this can lead to a graying effect on the clothes as the detergent builds up over time, can contribute to a roughness feeling, and potentially may even affect skin allergies. The excess detergent can also negatively affect the efficacy of the fabric softener during the rinse cycle. Excess detergent can also cause excess suds which may be undesirably left on the clothes after a wash cycle, cause damage to the washing machine, and/or cause the spin speed to decrease therefore causing the clothes to retain too much water.

As a convenience to the consumer, systems for automatically dispensing detergent and/or fabric softener can be provided. Such automatic systems can store one or more fluid additives in bulk and dispense at the appropriate times during a wash cycle. Challenges are still encountered, however, in metering the appropriate amount of the fluid into a wash or rinse cycle with such automatic systems.

For example, while a pump—such as a peristaltic pump—can be used to meter the fluid additives in reasonably accurate quantities, such adds a significant cost to the manufacture of an appliance. Additionally, a control system must be provided to properly operate the pump during the various cycles of the appliance. Less expensive pumping devices, such as an aspirator as indicated in e.g., in U.S. Pat. No. 2,712,747, may be used. However, these alternatives also present certain challenges. By way of example, where an aspirator is utilized, a fluid such as water can be passed through the aspirator to pull a fluid additive from a bulk dispenser and deliver the same to another part of the appliance such as a wash tub. The amount of fluid dispensed in such manner is determined in part by the velocity of water through the aspirator.

Unfortunately, the pressure available from the user or consumer's water supply can vary substantially. Not only can the water pressure vary from consumer to consumer, but significant pressure variations can also occur at a particular user's location depending upon e.g., simultaneous water usage for bathing and/or by other appliances, etc. These variations can significantly impact the dosage of fluid additive where a pumping device such as an aspirator is utilized because the suction available to pull fluid additive from a bulk dispense container will vary with changes in the water pressure provided to the aspirator.

Additionally, different fluid additives may have different densities and/or viscosities that can significantly affect the flow characteristics. As such, simply using a predetermined pumping time to deliver a fluid additive into e.g., the wash tub of the appliance can lead to undesirable variations and incorrect quantities in the amount of fluid additive delivered where substantial changes in viscosity and/or density occur between different fluid additives that may be used in the appliance.

Thus, a system for metering a fluid in an appliance would be useful. More particularly, a system that can enhance the delivery of accurate amounts of fluid additive during a wash or rinse cycle of an appliance would be beneficial. Such a system that can make adjustments for differences in the water pressure available to the appliance and/or differences in density or viscosity of the fluid additives would be particularly useful.

BRIEF DESCRIPTION OF THE INVENTION

Aspects and advantages of the invention will be set forth in part in the following description, or may be obvious from the description, or may be learned through practice of the invention.

In one exemplary aspect, the present invention provides a method for calibrating a fluid additive dispensing system for an appliance. The dispensing system includes at least one bulk dispense container of fluid additive connected to a pumping device. The method includes the steps of providing a pressure sensor configured for providing one or more pressure measurements of the fluid additive flowing between the pumping device and the bulk dispense container; measuring the pressure $P_s$ of the fluid additive while the pumping device is inactive; activating the pumping device for a predetermined time interval $\Delta t_{test}$ sufficient to draw fluid additive from the bulk container; deactivating the pumping device; measuring the amount of pressure increase $\Delta P_{INT}$ above $P_s$ in the fluid additive after said step of deactivating; and, using the pressure increase $\Delta P_{INT}$ and to $P_s$ to determine the time interval $t_{tot}$ required to operate the pumping device so as to deliver a certain quantity of fluid additive.

In another exemplary embodiment, the present invention provides a system for dispensing a fluid additive in an appliance. The system includes a tank for storing the fluid additive. A pumping device is included for drawing fluid from the tank, the pumping device connectable with a water supply and connected to the tank. A pressure sensor is configured for providing one or more pressure measurements of fluid between the tank and the pumping device. At least one processing device is configured for providing a pressure sensor configured for providing one or more pressure measurements of the fluid additive flowing between the pumping device and the bulk dispense container; measuring the pressure $P_s$ of the fluid additive while the pumping device is inactive; activating the pumping device for a predetermined time interval $\Delta t_{test}$ sufficient to draw fluid additive from the bulk container; deactivating the pumping device; measuring the amount of pressure increase $\Delta P_{INT}$ above $P_s$ in the fluid additive after said step of deactivating; and, using the pressure increase $\Delta P_{INT}$ and to $P_s$ to determine the time interval $t_{tot}$ required to operate the pumping device so as to deliver a certain quantity of fluid additive.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
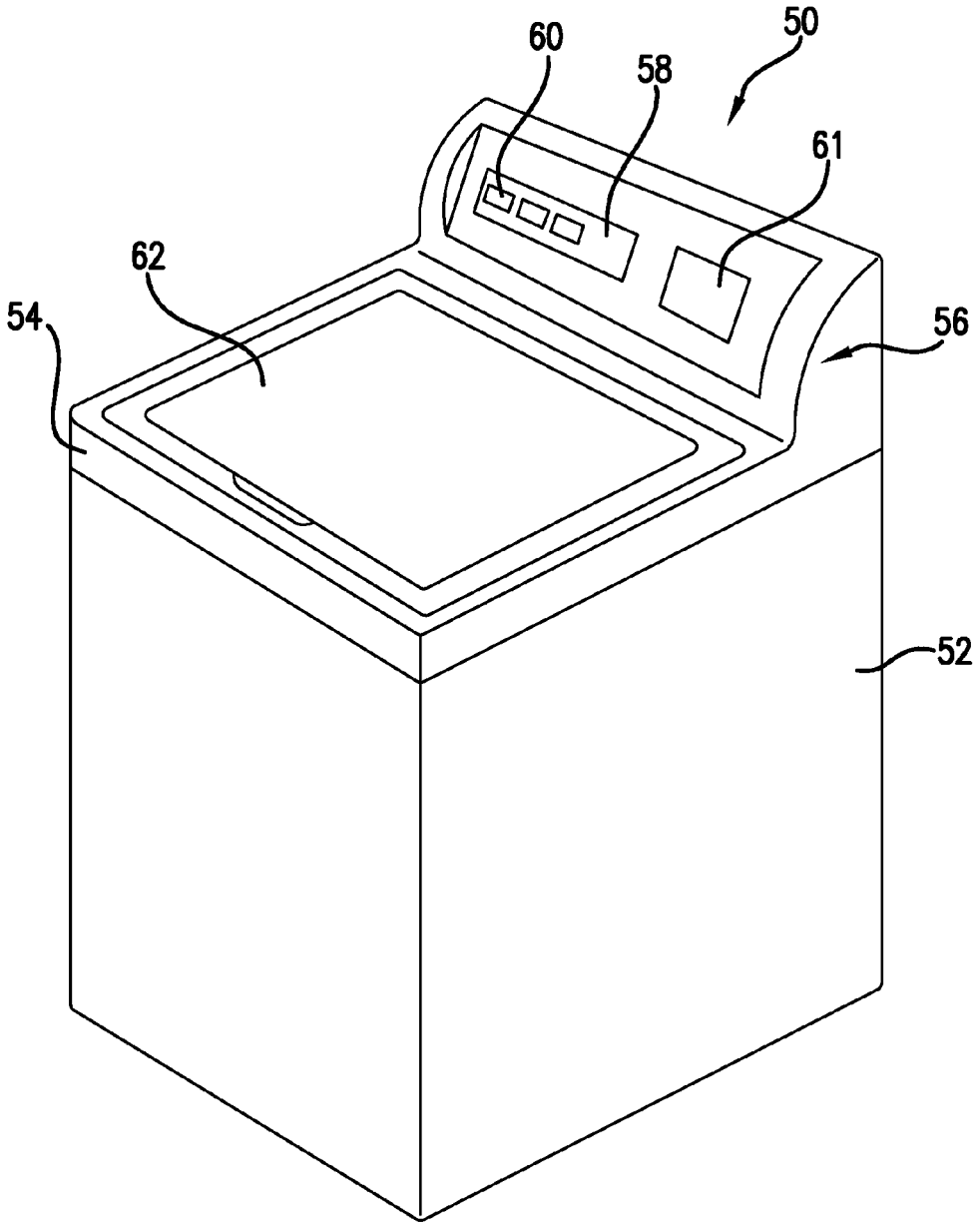
FIG. 1 provides an exemplary embodiment of a washing machine according to the present invention.

The present invention provides a system for calibrating a fluid additive dispensing system of an appliance such as e.g., a washing machine. For example, the system can calibrate for significant differences in the pressure of the water supply provided to the appliance during operation. Calibrations can also be implemented for significant differences in viscosity and/or density of the fluid additives. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
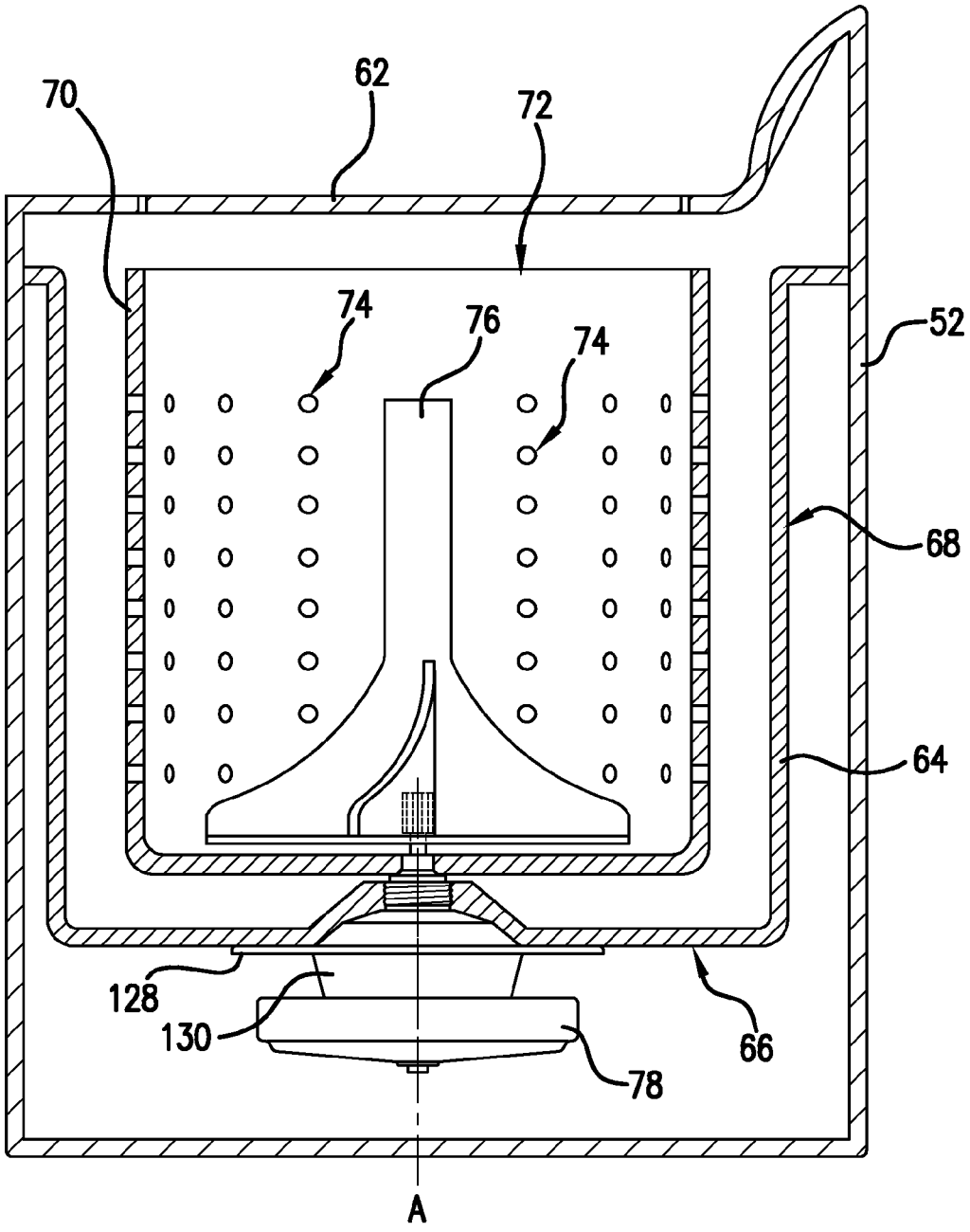
FIG. 2 provides a schematic, cross-sectional view of the exemplary embodiment of FIG. 1.

FIG. 1 is a perspective view of an exemplary vertical axis washing machine 50 including a cabinet 52 and a top cover 54. FIG. 2 is a side cross-sectional view of the exemplary embodiment of FIG. 1. While a vertical axis washing machine is used to describe an example embodiment of the present invention, it will be understood by one of skill in the art using the teachings disclosed herein that the present invention is not limited to this particular appliance configuration. Instead, vertical and horizontal axis washing machines in a variety of configurations as well as other appliances incorporating a bulk dispense system may also be employed with embodiments of the present invention.

A backsplash 56 extends from cover 54, and a control panel 58 including a plurality of input selectors 60 is coupled to backsplash 56. Control panel 58 and input selectors 60 collectively form a user interface input for operator selection of machine cycles and features. For example, in one embodiment, a display 61 indicates selected features, a countdown timer, and/or other items of interest to machine users. A door or lid 62 is mounted to cover 54 and is rotatable about a hinge (not shown) between an open position (not shown) facilitating access to wash tub 64 located within cabinet 52, and a closed position (shown in FIG. 1) forming an enclosure over wash tub 64. Wash tub 64 includes a bottom wall 66 and a sidewall 68, and a basket 70 that is rotatably mounted within wash tub 64. A pump assembly (not shown) is located beneath tub 64 and basket 70 for gravity assisted flow when draining tub 64.

Referring now to FIG. 2, wash basket 70 is movably disposed and rotatably mounted in wash tub 64 in a spaced apart relationship from tub sidewall 68 and the tub bottom 66. Basket 70 includes an opening 72 for receiving wash fluid and a wash load therein. Basket 70 includes a plurality of perforations 74 therein to facilitate fluid communication between an interior of basket 70 and wash tub 64.

An agitation element 76, such as a vane agitator, impeller, auger, or oscillatory basket mechanism, or some combination thereof is disposed in basket 70 to impart an oscillatory motion to articles and liquid in basket 70. In different embodiments, agitation element 76 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 76 is oriented to rotate about a vertical axis A. Basket 70 and agitator 76 are driven by pancake motor 78, which operates to turn or rotate agitator 76 and/or basket 70 with tub 64 as will be more fully described below.

Operation of machine 50 is controlled by a controller or processing device (not shown) that is operatively coupled to a control panel or user interface input 58 located on washing machine backsplash 56 (shown in FIG. 1) for user manipulation to select washing machine cycles and features. In response to user manipulation of the user interface input 58, the controller operates the various components of machine 50 to execute selected machine cycles and features. As used herein, "processing device" or "controller" may refer to one or more microprocessors or semiconductor devices and is not restricted necessarily to a single element. The processing device can be programmed to operate appliance 50 according to methods well known in the art. The processing device may include, or be associated with, one or memory elements such as e.g., electrically erasable, programmable read only memory (EEPROM).

In an illustrative embodiment, laundry items are loaded into basket 70, and washing operation is initiated through operator manipulation of control input selectors 60 (shown in FIG. 1). Wash tub 64 is filled with water and mixed with detergent to form a wash fluid. The contents of the basket 70 are agitated with agitation element 76 for cleansing of laundry items in basket 70. More specifically, agitation element 76 is moved back and forth in an oscillatory back and forth motion. In the illustrated embodiment, agitation element 76 is rotated clockwise a specified amount about the vertical axis of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 76 during the strokes imparts mechanical energy to articles in basket 70 for cleansing action. The strokes may be obtained in different embodiments with a reversing motor, a reversible clutch, or other known reciprocating mechanism.

After the agitation phase of the wash cycle is completed, tub 64 is drained with the pump assembly. Laundry items are then rinsed and portions of the cycle repeated, including the agitation phase, depending on the particulars of the wash cycle selected by a user. One or more spin cycles may also be used. In particular, a spin cycle may be applied after the wash cycle and/or after the rinse cycle in order to wring wash fluid from the articles being washed. During a spin cycle, basket 70 is rotated at relatively high speeds. Preferably, basket 70 is held in a fixed position during portions of the wash and rinse cycle while agitator 76 is oscillated as described. During portions of the spin cycle, basket 70 is also rotated to help wring fluid from the laundry articles through holes 74.

As previously indicated, one or more fluid additives such as detergent, fabric softener, etc. may be added to the wash tub 64 (or other chamber or bin of an appliance) during the above-described cycles. For convenience to the user, an automatic dispensing system can be provided by which such fluid additives are automatically dispensed. Such system can be equipped with e.g., at least one processing device for controlling the system according to one or more methods as described herein.

Figure 3:
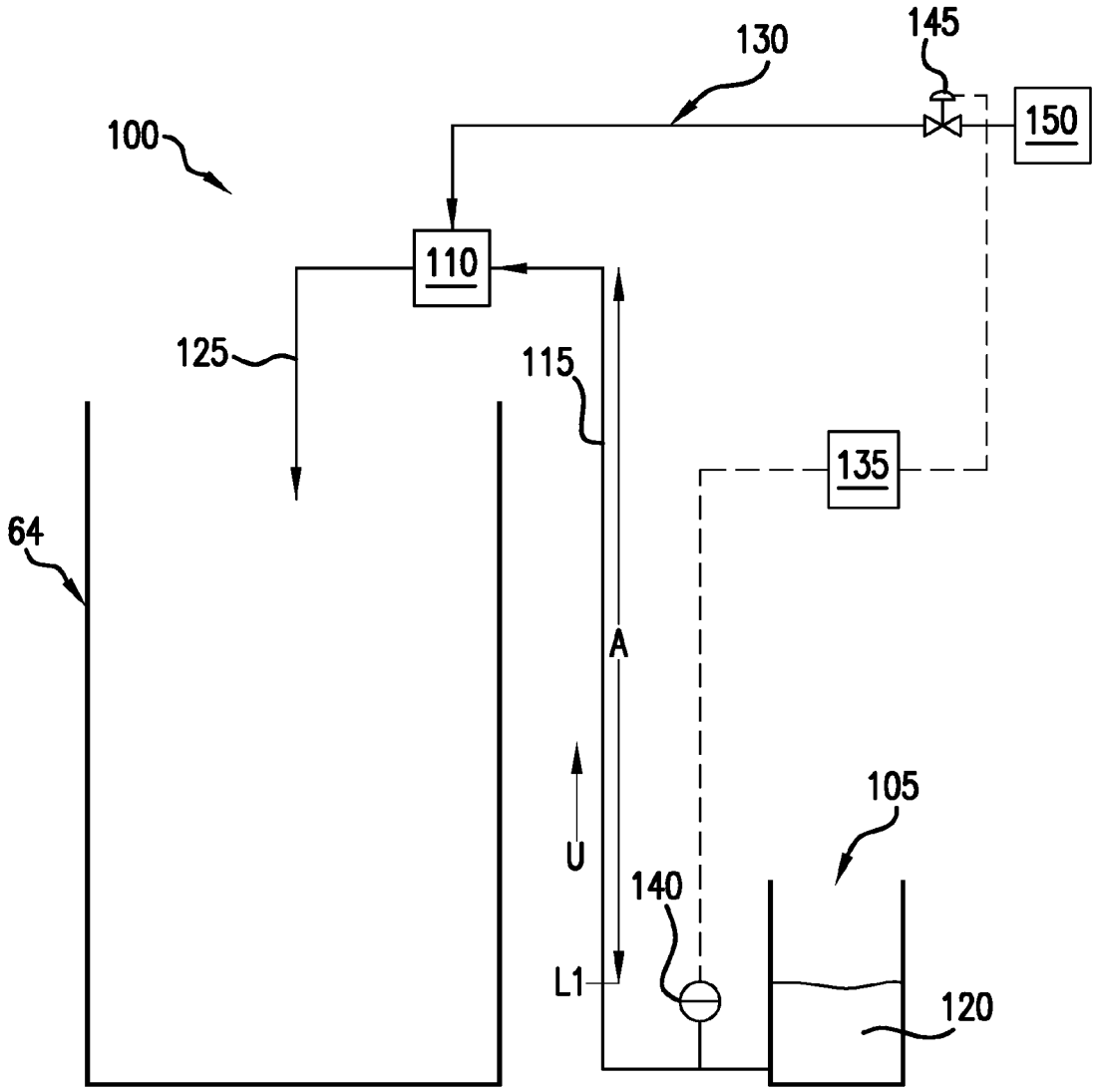
FIG. 3 is schematic view of an exemplary embodiment of a fluid dispensing system of the present invention as can be employed with the exemplary appliance of FIG. 1.

FIG. 3 provides a schematic illustration of an exemplary embodiment of such a dispensing system 100. A bulk dispensing tank 105 is provided that contains a fluid additive 120 such as e.g., detergent or fabric softener. While only one such tank is shown for this exemplary embodiment, multiple tanks may be used with an appliance depending upon how many different fluid additives are being provided for automatic dispensing. Tank 105 preferably is contained within cabinet 52. However, other placements may also be used.

Using fluid conduit 115, tank 105 is connected to a first inlet of a pumping device, which for this exemplary embodiment is configured as an aspirator 110. The pumping device, however, could be selected from various types of devices including other types of pumps. Aspirator 110 has a second inlet connected by line 130 to water supply 150. The flow of water through line 130 is controlled by valve 145 as directed by controller 135. Upon opening valve 145, a suction is created in line 115 that will draw fluid additive from tank 105. The amount of suction that will be generated by aspirator 110 depends on the amount water pressure available from water supply 150.

Fluid conduit 115 could be e.g., one or more fluid channels constructed from hoses, tubes, and/or pipes extending between tank 105 and aspirator 110. For example, tank 105 may located near the bottom of the appliance such that tube 115 extends from a connection at or near the bottom of tank 105 to aspirator 110. Similarly, fluid conduit 125 delivers fluid from the outlet of aspirator 110 to wash chamber or tub 64.

A pressure sensor 140 is positioned on line 115 between bulk dispense container 105 and aspirator 110. Although not required, for this exemplary embodiment, pressure sensor 140 is located at or below the bottom of container 105 so that during non-flow conditions, pressure sensor 140 provides a signal indicative of the amount fluid additive remaining in container 105. In addition, pressure sensor 140 also provides pressure measurements when fluid is moving in line 115 between container 105 and aspirator 110.

Where aspirator 110 is e.g., positioned higher than the fluid additive 120 in bulk container 105, aspirator 110 must be primed before it will deliver fluid additive 120. More specifically, when valve 145 is closed, aspirator 110 does not create a suction in line 115, which in turn allows fluid additive 120 to flow back to bulk container 105 and e.g., air to enter line 115. Thus, when valve 145 is opened and water flows through aspirator 110, a delay occurs—referred to herein as the time to prime $t_p$—for fluid additive 120 to refill line 115 and begin flowing through aspirator 110.

As stated, a processing device or controller 135 is used to operate valve 145 (and could also be used to control the pumping device) so as to draw fluid additive 120 from tank 105 and deliver the same to wash bin 64. As such, aspirator 110 and valve 145 can be used to meter fluid additive 120 into wash bin 64. For example, knowing the time to prime aspirator 110, $t_p$, as well as the time necessary to dispense a certain amount of fluid additive once primed, $t_d$, controller 135 can operate valve 145 (and/or a pumping device) for the total time interval $t_{tot}=t_p+t_d$ needed to deliver the desired amount of fluid additive 120 from tank 105. In general, shorter time intervals $t_{tot}$ can be used to deliver less fluid and longer time intervals $t_{tot}$ can be used to deliver more fluid. As stated, other configurations may be used as well for metering fluid additive 120 to wash bin 64.

For a given model of appliance such as washing machine 50, the time to prime, $t_p$, as well as the time necessary to deliver a certain amount of fluid additive once primed, $t_d$, will vary depending upon certain factors. In particular, where aspirator 110 (or another device that is dependent on the amount of pressure in water supply 150) is used as the pumping device, $t_p$ and $t_d$ will both depend on the water pressure available to create suction using aspirator 110. As stated above, this pressure can vary not only from one user location to another but can also vary at given location depending upon other water usage that may occur when the appliance is in operation. Additionally, $t_p$ and $t_d$ will depend on the amount of fluid additive 120 present in bulk container 105 and its location relative to aspirator 110. Finally, $t_p$ and $t_d$ can also be affected by significant changes in the viscosity of the bulk dispense fluid 120 such as might occur if different fluids are switched out or used for fluid 120 or if multiple bulk dispense containers are used with each having a different fluid additive.

Pressure sensor 140 can be used to calibrate dispensing system 100 and provide adjustments to improve the accuracy of $t_p$ and $t_d$ over changes in the available water pressure as well as changes in the identity of the fluid additive 120. An exemplary method of operating sensor 140 to provide such calibration will be now be described, it being understood that variations in the method may be applied using the teachings disclosed herein. Additionally, the exemplary method described herein can be used to provide for the calibration of the dispensing system of washing machines having configurations different than machine 50 as well as other types of appliances having an automatic dispensing system.

Accordingly, in one exemplary aspect of the invention, appliance 50 can be calibrated by measuring the pressure $P_s$ during static conditions (when valve 145 is closed so that aspirator 110 is not operating) and by measuring a pressure increase $\Delta P_{INT}$ that occurs when valve 145 is opened and then closed over a relatively short period of time $\Delta t_{test}$. By knowing the relationship between $t_p$ and $t_d$ a as function of the static pressure condition $P_s$ and the pressure increase $\Delta P_{INT}$ for a given appliance 50, the time interval $t_{tot}=t_p+t_d$ needed to deliver the desired amount of fluid additive 120 from tank 105 can be determined with reasonable accuracy.

Figure 4:
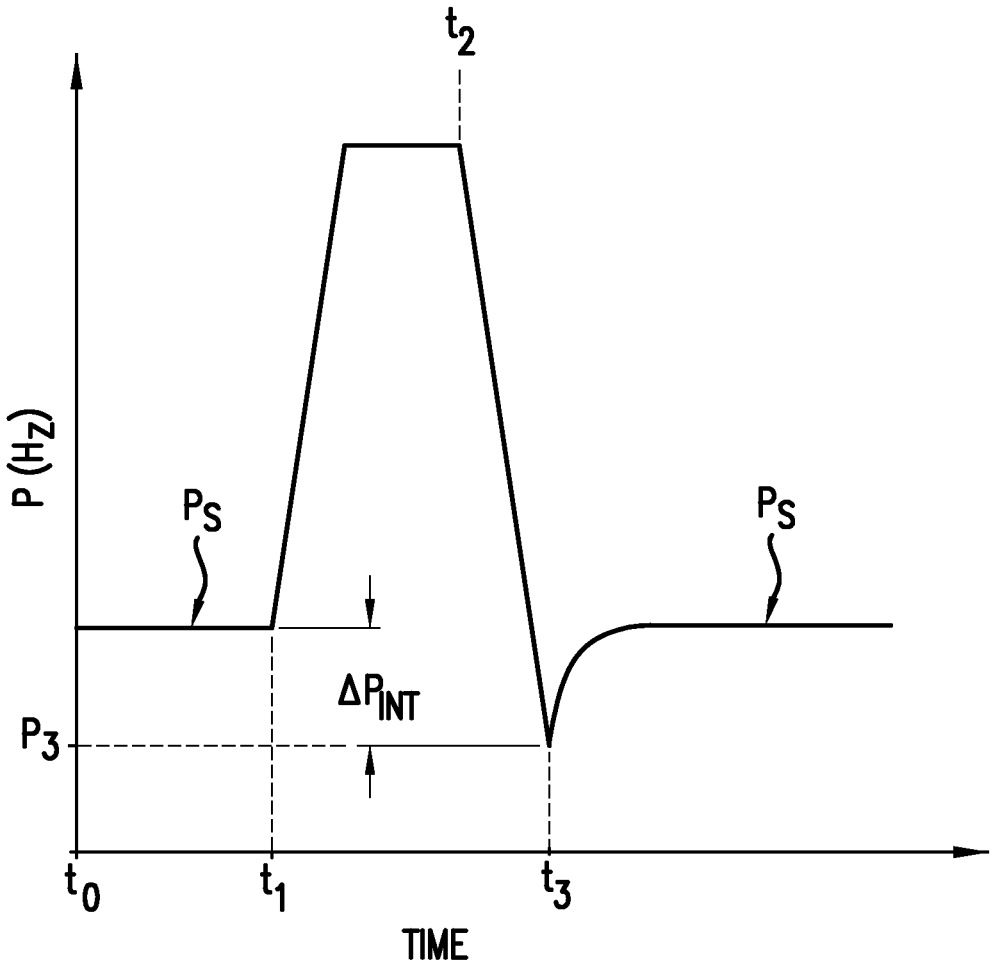
FIG. 4 is a plot of a representative output signal from a pressure sensor as further discussed herein.

More particularly, referring now to FIG. 4, a representative plot of the output signal (in Hertz) from pressure sensor 140 versus time is shown. For the exemplary embodiment described herein, pressure sensor 140 provides a signal where frequency in Hertz (Hz) is used to provide the pressure measurement. For this particular sensor 140, a higher Hertz value indicates a relatively lower pressure while a lower Hertz value indicates a relatively higher value. Other pressure sensor configurations may be used as well.

Continuing with FIG. 4, before valve 145 is opened and while there is no flow of fluid additive along line 115, pressure sensor 140 is used to provide a pressure measurement, $P_s$, which represents the pressure at static conditions. At time $t_1$, valve 145 is opened by controller 135 and then closed at time $t_2$ such that valve 145 was open only for a predetermined time interval $\Delta t_{test}=t_2-t_1$. Upon closing valve 145 at time $t_2$, fluid additive in line 115 falls away from aspirator 110 and back into bulk container 105 causing the pressure as measured by pressure sensor 140 and reported to controller 135 to reach a maximum value at time $t_3$.

The difference between the pressure $P_3$ as measured at time $t_3$ and the pressure at static conditions $P_s$ is defined as pressure increase $\Delta P_{INT}$. As such, pressure increase $\Delta P_{INT}$ represents the amount (for a given level of a fluid additive 120 in container 105) by which the pressure as measured and reported by sensor 140 exceeds the static pressure value $P_s$ once valve 145 is closed.

The value of pressure increase $\Delta P_{INT}$ will be determined in part by how much fluid was drawn into line 115 during the time interval $\Delta t_{test}$. In turn, how much fluid was drawn into line 115 is dependent upon the amount of water pressure that was available to aspirator 110 over time interval $\Delta t_{test}$, the amount of fluid additive 120 in container 105, as well as the viscosity and density of the fluid additive 120 in container 105. Using these values for $P_s$ and $\Delta P_{INT}$ from $\Delta t_{test}$, and knowing the relationship, for a particular appliance design, between the time to prime $t_p$ as a function of the static pressure $P_s$ and $\Delta P_{INT}$, the time to prime $t_p$ the appliance can be determined. Similarly, by knowing the relationship for a particular appliance, between the time to dispense $t_d$ as a function of the static pressure $P_s$ and $\Delta P_{INT}$, the time to dispense $t_d$ a given quantity of fluid additive in the appliance can also be determined. The aforementioned relationships for the time to prime $t_p$ and the time to dispense $t_d$ can be determined, for example, experimentally. Such experimental results could be e.g., modeled with equations or provided as one or more data sets that are available to controller 135 to reference during operation of appliance 50.

Figure 5:
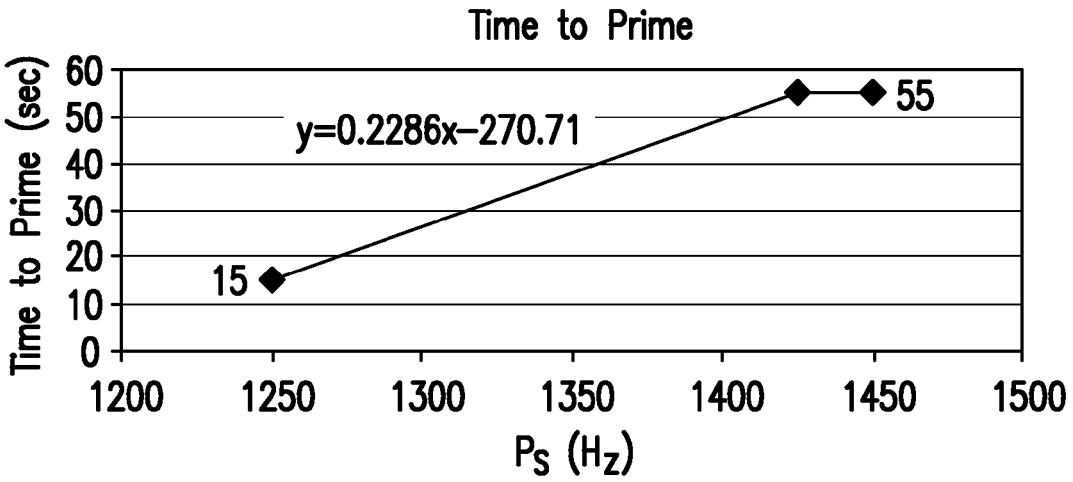
FIGS. 5-12 provide data plots for time to prime and time to dispense for a given appliance at different water pressures as will be further described.
Figure 6:
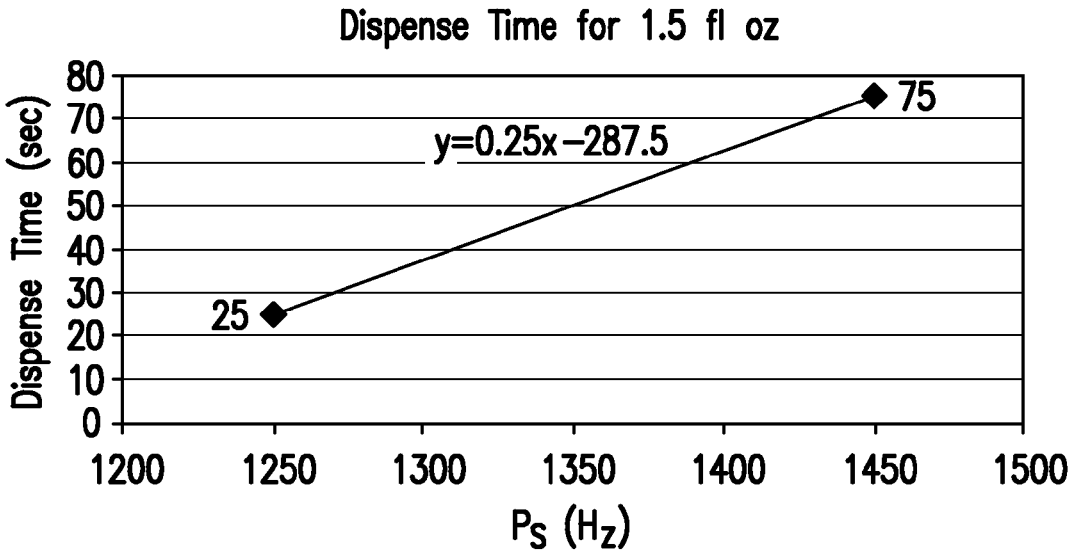
Figure 7:
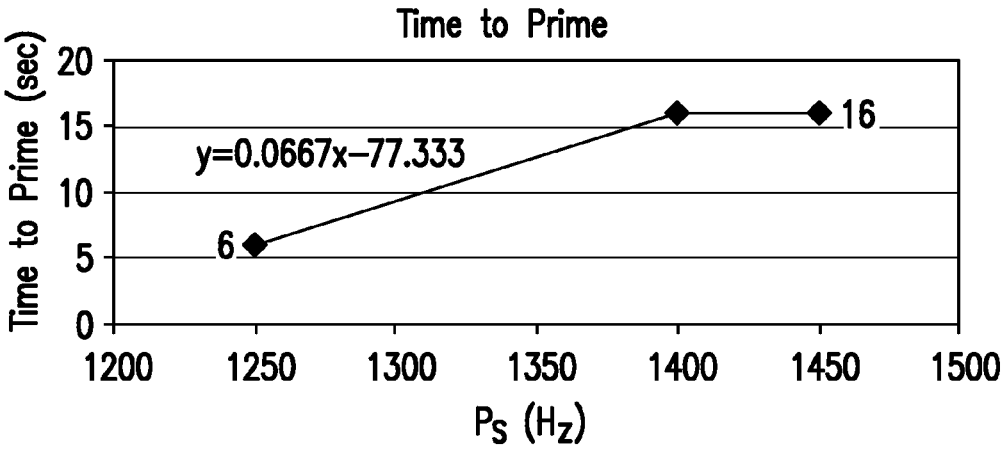
Figure 8:
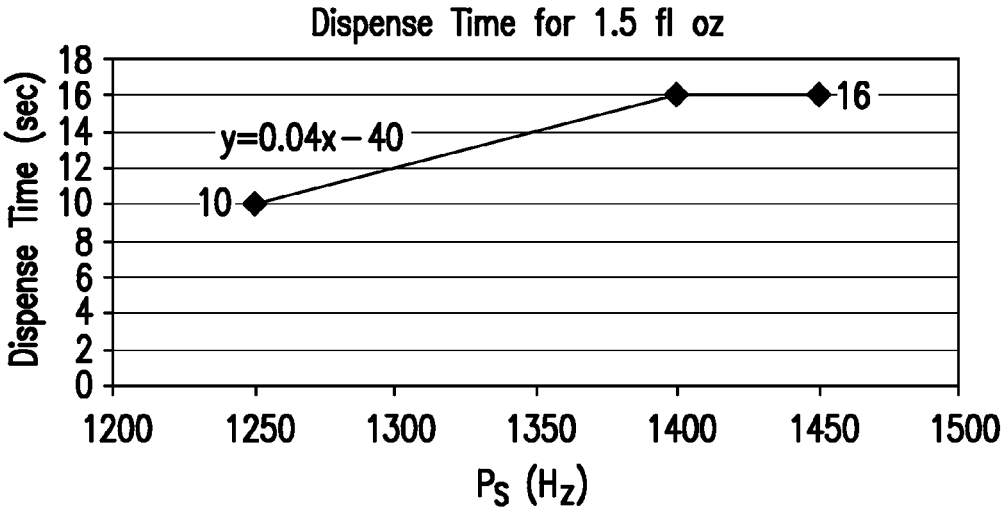
Figure 9:
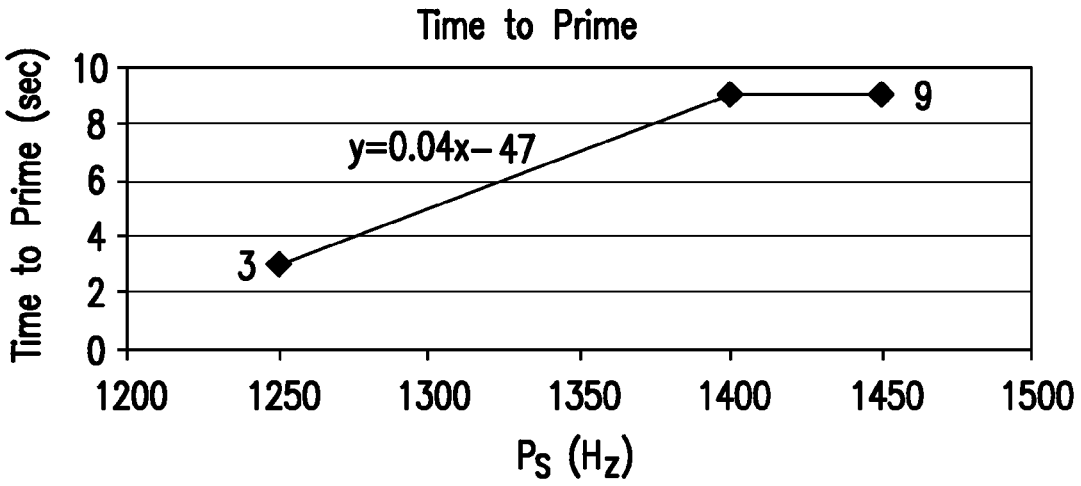
Figure 10:
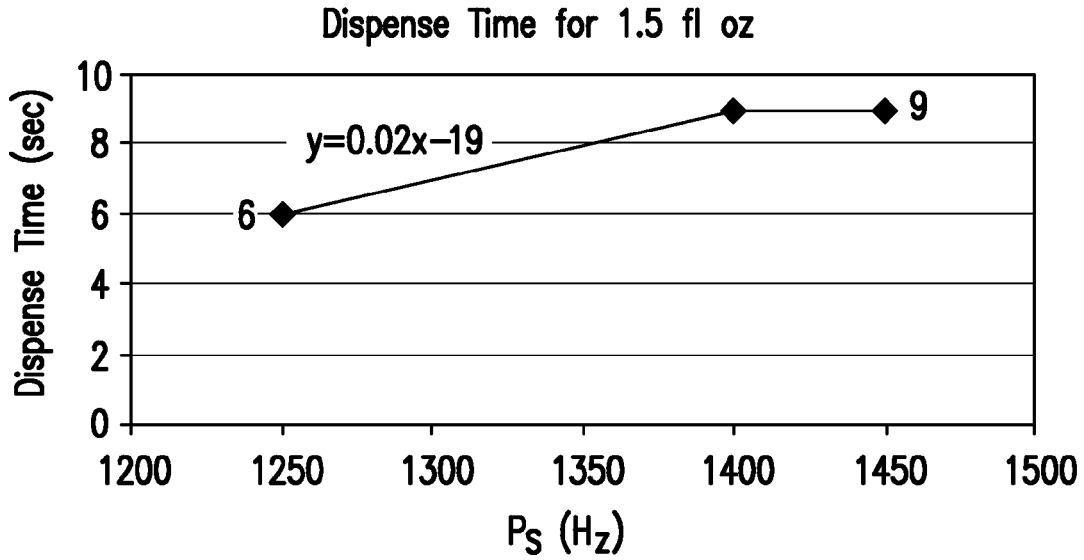
Figure 11:
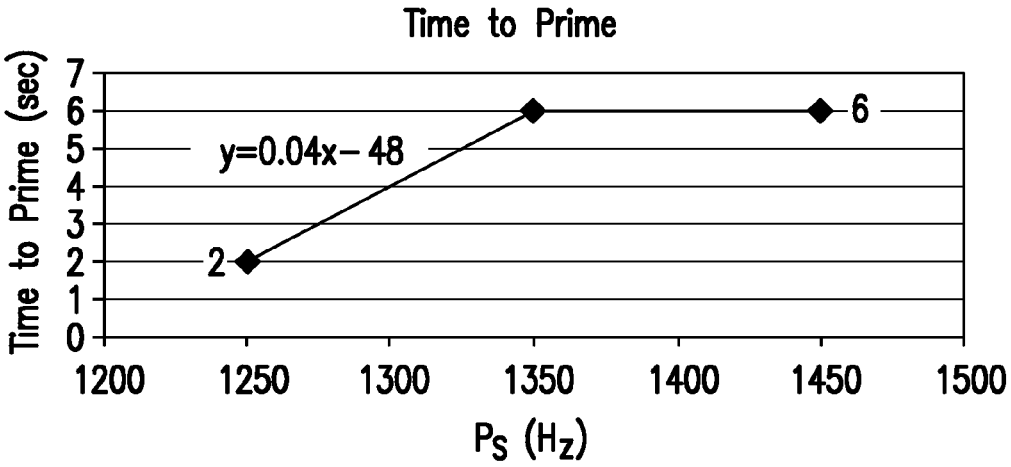
Figure 12:
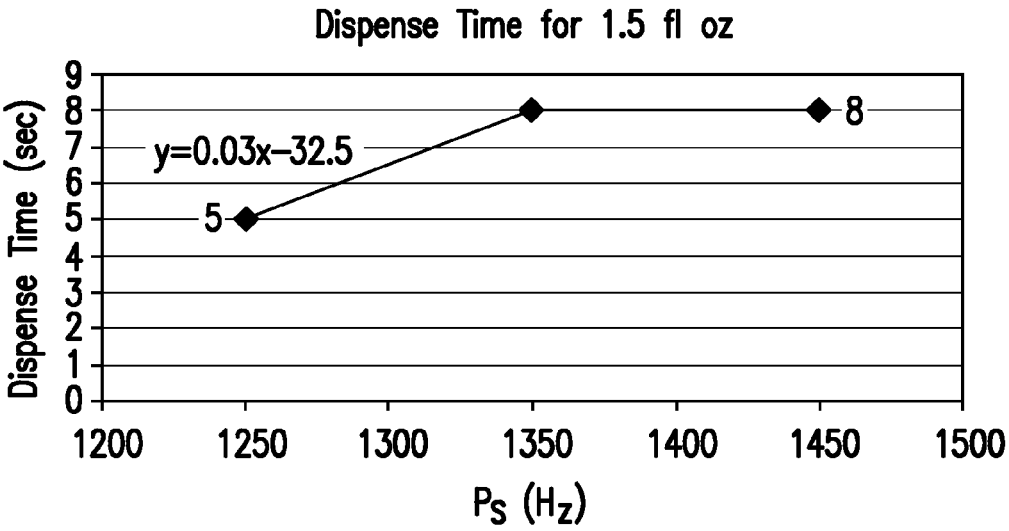

For example, FIGS. 5-12 represent experimentally determined plots that were developed using the same fluid additive over different water pressures available to an appliance such as appliance 50. FIGS. 5 and 6 represent the relationships between the time to prime $t_p$ and time to dispense $t_d$ as a function of the static pressure $P_s$ for given water pressure $P_{WP1}$ available to aspirator 110 of appliance 50 using a time interval $\Delta t_{test}$ of two seconds with the given fluid additive. FIGS. 7 and 8 represent the same relationships for a different water pressure $P_{WP2}$, where $P_{WP2}>P_{WP1}$, and with a time interval $\Delta t_{test}$ of two seconds using same fluid additive as in FIGS. 5 and 6. FIGS. 9 and 10 represent the same relationships for a different water pressure $P_{WP3}$, where $P_{WP3}>P_{WP2}$, and with a time interval $\Delta t_{test}$ of two seconds using same fluid additive as in FIGS. 5 and 6. Finally, FIGS. 11 and 12 represent the same relationships for a different water pressure $P_{WP4}$, where $P_{WP4}>P_{WP3}$, and with a time interval $\Delta t_{test}$ of two seconds using same fluid additive as in FIGS. 5 and 6.

By way of illustration, at a water pressure of $P_{WP1}$ provided by water supply 150 to aspirator 110 and a static pressure $P_s$ of 1250 Hz, the time to prime $t_p$ (FIG. 5) was determined to be 15 seconds and the time to dispense $t_d$ (FIG. 6) was determined to 25 seconds. Through determining the time to prime $t_p$ and time to dispense $t_d$ at other static pressures $P_s$ for a given water pressure $P_{WP1}$, the data could be graphed and a model provided for the data as shown by the equations indicated with FIG. 5 and FIG. 6. The plots in FIGS. 7-12 were developed similarly for water pressures $P_{WP2}$, $P_{WP3}$, and $P_{WP4}$.

The data plots provided in FIGS. 5-12 can be used to provide a determination of time to prime $t_p$, time to dispense $t_d$, and/or $t_{tot}$ for appliance 50 even when different fluid additives are used and/or different water pressures are available from water supply 150. More specifically, after appliance 50 is connected with water supply 150 (such as e.g., after being installed at a customer's location) and while valve 145 remains closed so that no water is flowing through aspirator 110, pressure sensor 140 measures the pressure $P_s$. Then, valve 145 is opened by controller 135 for a predetermined time interval, $\Delta t_{test}$, of the same duration as was used to develop FIGS. 5-12—in this case about two seconds. The value of $\Delta P_{INT}$ is then determined. Controller 135 then determines which equation (or data plot) of FIGS. 5-12 to reference using e.g., Table I as provided below. Table I provides a correlation between the plots of FIGS. 5-12 and certain ranges of static pressures $P_s$ and $\Delta P_{INT}$.

TABLE I

| Pressure $P_s$ (Hz) | $\Delta P_{INT}$ (Hz) | | | |
|---|---|---|---|---|
| 1250-1325 | 20-30 | 30-40 | 40-50 | 50-60 |
| 1325-1430 | 40-60 | 60-80 | 80-90 | 90-100 |
| 1430-1450 | 40-60 | 60-80 | 80-90 | 90-100 |
| | FIGS. 5 & 6 | FIGS. 7 & 8 | FIGS. 9 & 10 | FIGS. 11 & 12 |

For example, given a pressure $P_s$ indicated by a signal of 1350 Hz from pressure sensor 140 and a $\Delta P_{INT}$ determined as a change of 70 Hz from pressure sensor 140, controller 135 would reference the data and/or equations represented in FIGS. 7 and 8 to determine time to prime $t_p$, time to dispense $t_d$, and/or $t_{tot}$ for appliance 50. The plots represented in FIGS. 6, 8, 10 and 12 represent dispensing about 1.5 ounces of fluid additive. However, other amounts may be dispensed as well by interpolating or using percentages for the values indicated in the plots. For example, the time to dispense $t_d$ as indicated in the figures can be doubled to deliver about 3 ounces or halved to deliver 0.75 ounces. This time to dispense would then be added to the time to prime $t_p$ in order to determine $t_{tot}$—which would be the total amount of time that valve 145 would be opened so as to prime and then dispense the desired quantity of fluid using aspirator 110.

The discussion above provides an example of the use of $\Delta P_{INT}$ and $P_s$ to determine the time needed to deliver a desired quantity of fluid using the experimentally determined relationships shown in Table I and FIGS. 5-12. Using the teachings disclosed herein, it will be understood, however, that other techniques for determining such relationships may be applied as well. It will be understood that such relationships should be developed for each model of an appliance that is to be calibrated because changes in the structure and design of the dispensing system from model to model can change the values of $P_s$ and/or $\Delta P_{INT}$ for a given time period $\Delta t_{test}$ and fluid additive.

Also, the length of $\Delta t_{test}$ can be e.g., two seconds (as used above) or some other arbitrary value. For example, other durations from $\Delta t_{test}$ could be used as well such as e.g., 1 second, 1.5 second, etc. Preferably, $\Delta t_{test}$ is of a duration that is sufficient to draw fluid additive out of bulk dispense container 105 and along line 115 for distance sufficient to determine $\Delta P_{INT}$. Also, $\Delta t_{test}$ as used during operation of the appliance preferably should match the value used to develop the models or charts that will be referenced by e.g., a controller for particular appliance.

Once controller 135 has determined the time interval $t_{tot}$ needed for the operation of aspirator 110 so as to deliver the desired quantity of fluid additive, controller 135 can open valve 145 for such time interval $t_{tot}$. If needed, controller 135 can also activate a pumping device for such time interval $t_{tot}$.

Figure 13:
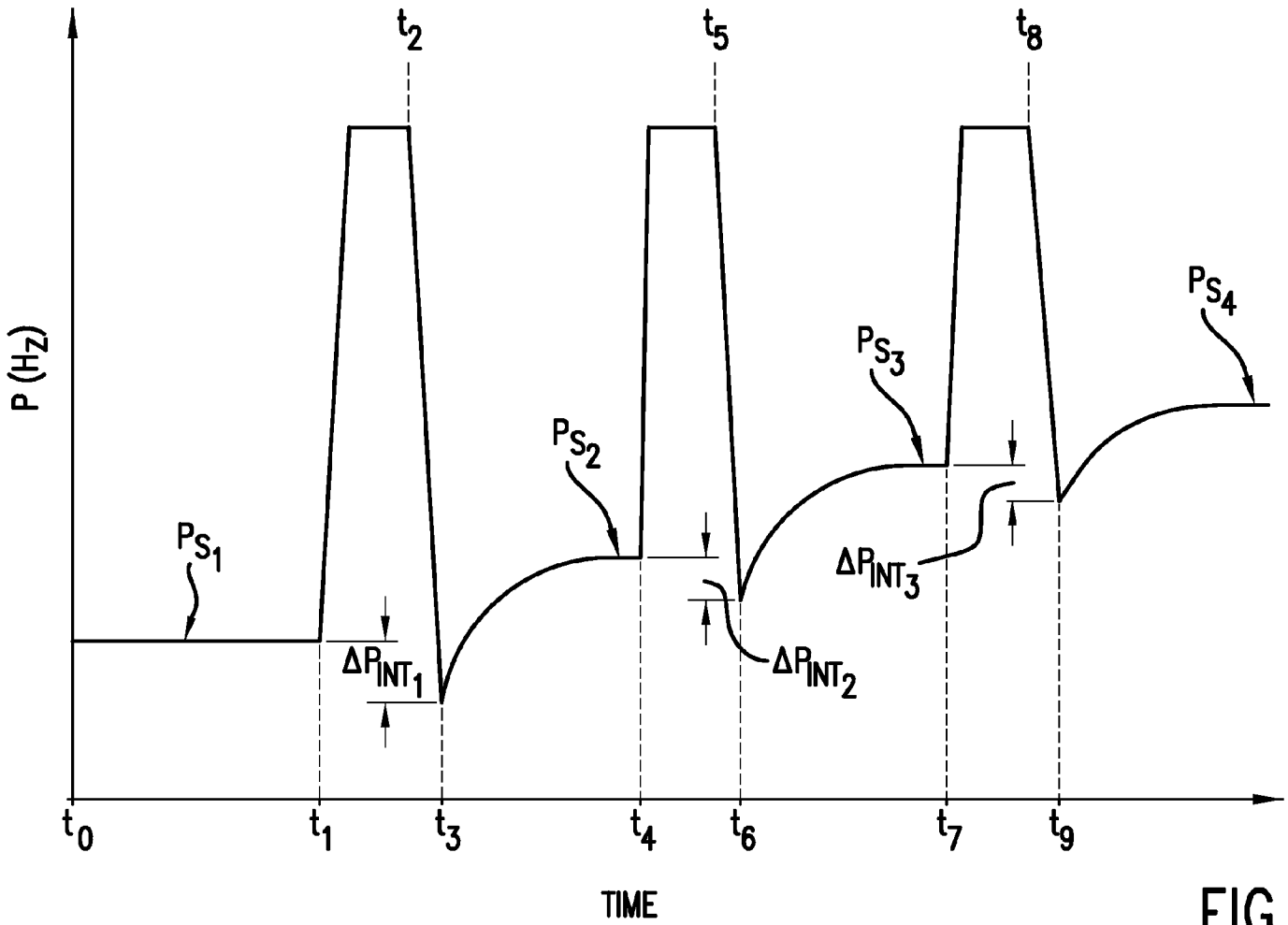
FIG. 13 is a plot of a representative output signal from a pressure sensor as further discussed herein.

FIG. 13 provides a plot representative of the pressure information that can be provided by pressure sensor 140 during operation of the appliance. Between time $t_0$ and time $t_1$, valve 145 is closed and pressure sensor 140 provides a first static pressure measurement $P_{S1}$ that can be used e.g., to determine the amount of fluid additive 120 in container 105. At time $t_1$, valve 145 is opened and then closed at time $t_2$. At time $t_3$, a pressure spike occurs. By time $t_4$, the pressure has returned to static conditions. As described above, the difference between the pressure at time $t_3$ and time $t_1$ is denoted as $\Delta P_{INT1}$ can be used to determine the time interval $t_{tot}$ required to operate the pumping device to deliver a certain quantity of fluid additive 120 after time $t_3$. The difference between the pressure at time $t_4$ and time $t_1$ can be used to determine the quantity of fluid additive 120 actually dispensed from container 105 as a result of opening valve 145 at time $t_2$ and closing valve 145 at time $t_3$.

As stated, at time $t_4$ the pressure in line 115 has returned to static conditions. Accordingly, know the static pressure value $P_{S2}$ and the value of $\Delta P_{INT1}$, controller 135 can determined the time interval $t_{tot}$ required to operate the pumping device to deliver a specific quantity of fluid using the steps as described above. More specifically, and by way of example, by using Table I and the plots in FIGS. 5-12 or similar data, controller 135 can determine the amount of time between time $t_4$ and $t_5$ the valve 145 must remain open to both prime aspirator 110 and dispense the desired quantity of fluid additive 120 from aspirator 110. The difference between pressure value $P_{S2}$ and $P_{S3}$ can be used to determine the actual amount of fluid additive 120 that was dispensed. This process can be repeated for subsequent dispensing of fluid additive 120 at time $t_7$ and so on.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for calibrating a fluid additive dispensing system for an appliance, the dispensing system including at least one bulk dispense container of fluid additive connected to a pumping device, the method comprising the steps of:

providing a pressure sensor configured for providing one or more pressure measurements of the fluid additive flowing between the pumping device and the bulk dispense container;

measuring the pressure $P_s$ of the fluid additive while the pumping device is inactive;

activating the pumping device for a predetermined time interval $\Delta t_{test}$ sufficient to draw fluid additive from the bulk container;

deactivating the pumping device;

measuring the amount of pressure increase $\Delta P_{INT}$ over pressure $P_s$ in the fluid additive after said step of deactivating; and, using the pressure increase $\Delta P_{INT}$ and pressure $P_s$ to determine the time interval $t_{tot}$ required to operate the pumping device so as to deliver a certain quantity of fluid additive.

2. A method for calibrating a fluid additive dispensing system for an appliance as in claim 1, wherein said step of using comprises:

applying one or more relationships between the pressure increase $\Delta P_{INT}$ and pressure $P_s$ to determine the time interval $t_{tot}$ needed to operate the pumping device so as to deliver a certain quantity of fluid additive.

3. A method for calibrating a fluid additive dispensing system for an appliance as in claim 2, wherein the one or more relationships used in said step of applying are developed empirically.

4. A method for calibrating a fluid additive dispensing system for an appliance as in claim 1, wherein said step of using further comprises:

applying a relationship between pressure increase $\Delta P_{INT}$, pressure $P_s$, and a time to prime $t_p$ over a range of different values for $\Delta P_{INT}$ and pressure $P_s$.

5. A method for calibrating a fluid additive dispensing system for an appliance as in claim 1, wherein said step of using further comprises:

applying a relationship between $\Delta P_{INT}$, pressure $P_s$, and a time to dispense $t_d$ over a range of different values for $\Delta P_{INT}$ and pressure $P_s$.

6. A method for calibrating a fluid additive dispensing system for an appliance as in claim 1, wherein the time interval $t_{tot}$ for operating the pumping device so as to deliver the certain quantity of fluid additive includes the time to prime the pumping device.

7. A method for calibrating a fluid additive dispensing system for an appliance as in claim 1, wherein the time interval $t_{tot}$ for operating the pumping device so as to deliver the certain quantity of fluid additive is the sum of a time to prime the aspirator, $t_p$, as well as a time necessary to deliver a certain amount of fluid additive once primed, $t_d$.

8. A method for calibrating a fluid additive dispensing system for an appliance as in claim 1, wherein the pumping device is an aspirator.

9. A method for calibrating a fluid additive dispensing system for an appliance as in claim 1, further comprising the step of positioning the pressure sensor at or near a bottom of the bulk dispense container.

10. A method for calibrating a fluid additive dispensing system for an appliance as in claim 1, further comprising the step of operating the pumping device for the time interval $t_{tot}$ so as to deliver fluid additive.

11. A method for calibrating a fluid additive dispensing system for an appliance as in claim 10, wherein said step of operating the pumping device comprises opening a valve connecting the pumping device with a water supply.

12. A system for dispensing a fluid additive in an appliance, comprising:

a tank for storing the fluid additive;

a pumping device for drawing fluid from the tank, the pumping device connectable with a water supply and connected to said tank;

a pressure sensor configured for providing one or more pressure measurements of fluid between said tank and said pumping device;

at least one processing device configured for;

measuring the pressure $P_s$ of the fluid additive while said pumping device is inactive;

activating the pumping device for a predetermined time interval $\Delta t_{test}$ sufficient to draw fluid additive from said tank;

deactivating said pumping device;

measuring the amount of pressure increase $\Delta P_{INT}$ above $P_s$ in the fluid additive after said step of deactivating; and, using the pressure increase $\Delta P_{INT}$ and to pressure $P_s$ to determine the time interval $t_{tot}$ required to operate the pumping device so as to deliver a certain quantity of fluid additive.

13. A system for dispensing a fluid additive in an appliance as in claim 12, wherein said at least one processing device is further configured for applying a relationship between $\Delta P_{INT}$, pressure $P_s$, and a time to prime $t_p$ over a range of different values for pressure increase $\Delta P_{INT}$ and pressure $P_s$.

14. A system for dispensing a fluid additive in an appliance as in claim 12, wherein said at least one processing device is further configured for applying a relationship between $\Delta P_{INT}$, pressure $P_s$, and a time to dispense $t_d$ over a range of different values for $\Delta P_{INT}$ and pressure $P_s$.

15. A system for dispensing a fluid additive in an appliance as in claim 12, wherein the appliance is a washing machine.

16. A system for dispensing a fluid additive in an appliance as in claim 12, wherein said pumping device comprises an aspirator.

17. A system for dispensing a fluid additive in an appliance as in claim 12, wherein said pressure sensor is positioned at or below a bottom portion of said tank.

* * * * *